United States Patent [19]

Gujer Peter et al.

[11] 4,019,690

[45] Apr. 26, 1977

[54] WINDING DEVICE FOR AUTOMATICALLY CHANGING BOBBIN TUBES

[75] Inventors: Gujer Peter, Effretikon; Olivier Wüst, Seuzach, both of Switzerland

[73] Assignee: Rieter Machine Works, Ltd., Winterthur, Switzerland

[22] Filed: Sept. 24, 1975

[21] Appl. No.: 616,253

[30] Foreign Application Priority Data

Oct. 4, 1974 Switzerland ..... 13360/74

[52] U.S. Cl. ..... 242/18 A; 242/18 PW

[51] Int. Cl.[2] ..... B65H 67/04; B65H 54/34

[58] Field of Search ..... 242/18 PW, 18 A

[56] References Cited

UNITED STATES PATENTS

| | | | |
|---|---|---|---|
| 2,036,121 | 3/1936 | Converse et al. | 242/18 PW |
| 3,075,715 | 1/1963 | Hensen et al. | 242/18 PW |
| 3,385,532 | 5/1968 | Sparling | 242/18 PW |
| 3,858,816 | 1/1975 | Corbiere | 242/18 PW |
| 3,920,193 | 11/1975 | Gujer et al. | 242/18 PW |

*Primary Examiner*—Richard E. Aegerter
*Assistant Examiner*—John W. Shepperd
*Attorney, Agent, or Firm*—Werner W. Kleeman

[57] ABSTRACT

A winding device for automatically changing tubes taking-up endless threads, with a thread deflecting device for lifting the thread off a thread traversing device, a thread holding device for guiding the thread in its lifted-off position during change of the bobbin tube, and at least two driven bobbin chucks which can be alternately brought into a bobbin or tube change position respectively. Each bobbin chuck supporting one tube, and a thread catching- and cutting zone is arranged adjacent one end of the associated tube and rotating therewith. Thread shifting means shift the thread guided by the thread holding device in a first shifting step from a position at the immediate vicinity of the catching- and cutting zone into an end portion of the tube adjacent thereto, and which thread shifting means in a second step shifts the thread over a predetermined distance on such tube for creating the reserve wraps, the thread shifting means shifting the thread at a higher shifting speed during the second step than during the first step. A thread guide element of the thread shifting means is movable in a direction substantially opposite to the direction of the thread shifting movement such that at least one additional shifting step is carried out and which is directed opposite to the abovementioned first and second shifting steps and such additional step occurring between such first and second shifting steps.

9 Claims, 13 Drawing Figures

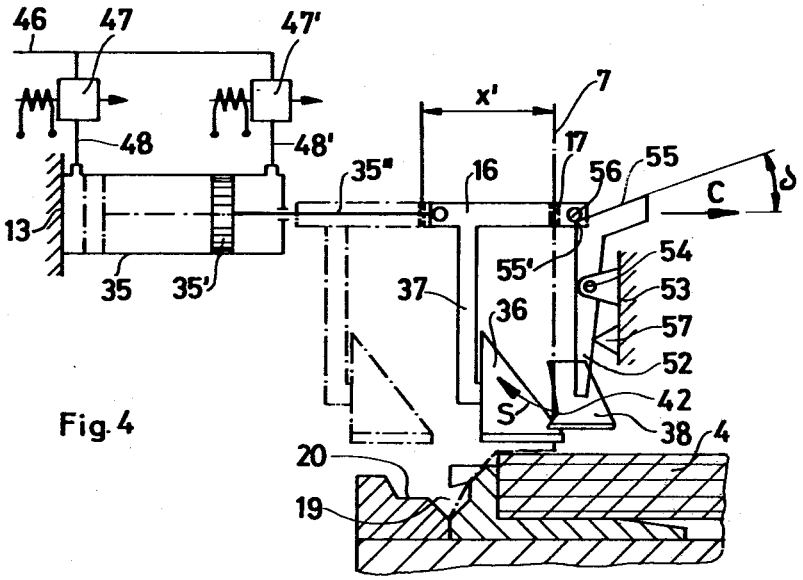
Fig. 4
Fig. 5
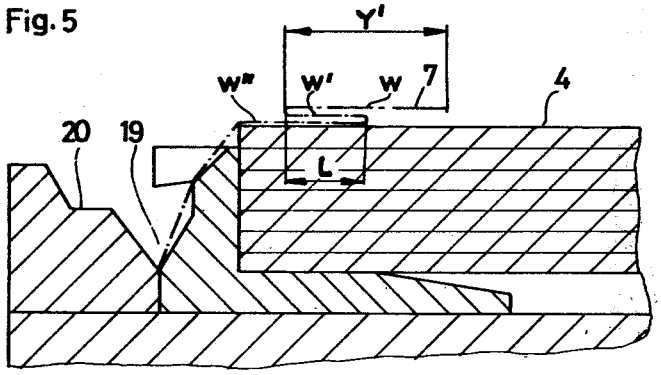

Fig. 9
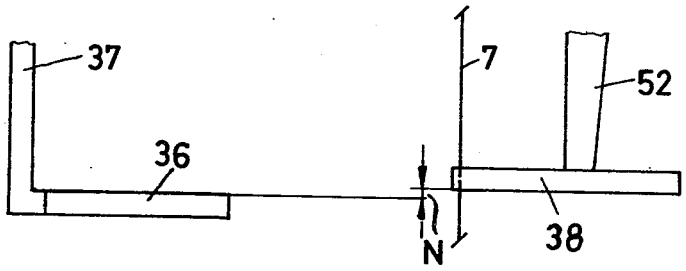
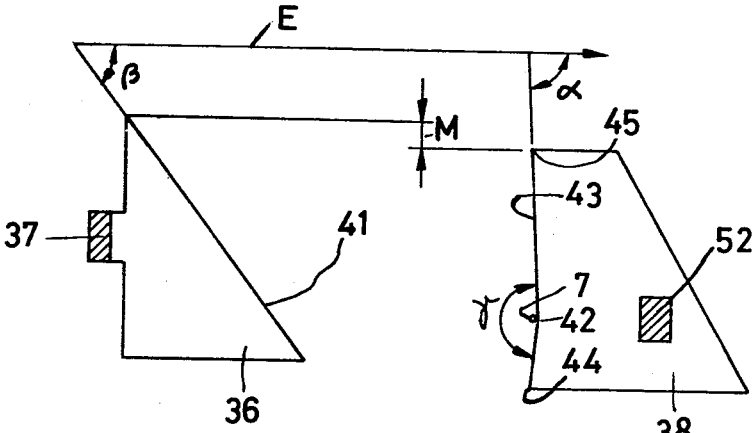
Fig. 10

WINDING DEVICE FOR AUTOMATICALLY CHANGING BOBBIN TUBES

BACKGROUND OF THE INVENTION

The present invention relates to a new and improved winding device for automatically changing bobbin tubes and constitutes an improvement upon the commonly assigned, copending Unites States application Ser. No. 447,853, filed Mar. 4, 1974, now U.S. Pat. No. 3,920,193 granted Nov. 18, 1975 and entitled "Winding Apparatus With Automatic Changing Of Tubes Or The Like", listing as the inventors Peter Gujer, Hans Schellenberg and Olivier Wuest.

In the aforementioned copending application there is taught to the art a winding device for automatically changing tubes for taking-up endless threads, filaments or the like —hereinafter generically simply broadly referred to as threads —, the winding device being of the type provided with a thread traversing device for generating threading winding-wraps, a thread deflecting device for lifting the thread-off the thread traversing device. There is further provided a thread holding device with a thread guiding device for guiding the thread in its lifted-off position during the change of the bobbin tube, and at least two driven bobbin chucks alternately brought into a bobbin or tube change position respectively, each of the bobbin chucks supporting one tube. A thread catching- and cutting zone is arranged adjacent to one end of the associated tube and rotates with such tube. The thread holding device is arranged such that the thread lifted-off the thread traversing device is guided thereby in the immediate vicinity of the thread catching- and cutting zone. A thread shifting means is provided for shifting the thread guided by the thread holding device in a first shifting step or phase from a position at the immediate vicinity of the threading catching and cutting zone through such zone and onto an end portion of the tube adjacent thereto, the thread shifting means in a second step or phase shifting the thread over a predetermined distance on the tube for creating reserve wraps, with the thread shifting means shifting the thread at a higher shifting speed during the second step or phase than during the first step or phase. During operation of this system there is produced a reserve winding —also called fixation winding—before the second shifting step is carried out, such reserve winding comprising a number of closely adjacent windings or wraps which are produced in such a manner that there can be obtained a sufficiently long, however, if possible, not a dangling thread reserve.

SUMMARY OF THE INVENTION

It is a primary object of the present invention to provide an improved winding device for automatically changing bobbin tubes equipped with novel means for the better fixation of reserve windings.

A further object of the invention aims at means for the improved fixation of reserve windings and wherein the reserve windings are wound in a number of superimposed layers or wraps in a direction opposite to one another.

Now in order to implement these and still further objects of the invention, the improvement aspects of this development are manifested by the features that the thread shifting means includes a thread guide element which is movable in a direction substantially opposite to the thread shifting direction in a manner such that there occurs at least one additional shifting step, which is directed opposite to the above-mentioned first and second thread shifting steps, said at least one additional shifting step occurring between the first and second thread shifting step.

Considering further the apparatus aspects of this development the thread guide element can be provided with a guide edge used for supporting or the bearing contact thereat of a sliding point or part of the thread holding device in such a manner that the sliding point can be located at such a distance from a thread guide of the thread holding device that if the thread contacts a guide notch of the thread guide element the sliding point contacts the guide edge, and while shifting or displacing away the guide edge such sliding point slides thereon, and thus, the thread guide element of the thread shifting device is movable in the opposite direction. Furthermore, the guide edge can be inclined in a direction away from the lengthwise axis of the bobbin chuck, viewed in the direction of movement of the thread holding device. Also the thread guide element can be constituted by a thread guide plate connected with a lever arranged to be pivotable substantially in the thread shifting direction and the thread guide plate can be arranged at one end of the lever and the thread guide edge can be arranged at the opposite end of such lever.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 5 is an enlarged sectional view of the bobbin chuck wherein the thread reserve has been schematically illustrated;

FIG. 9 is an enlarged elevational view showing a detail of a portion of the arrangement of FIG. 4;

FIG. 10 is a top plan view of FIG. 9;

DETAILED DESCRIPTION OF THE PREFERRED EMBODIMENTS

Figure 1:
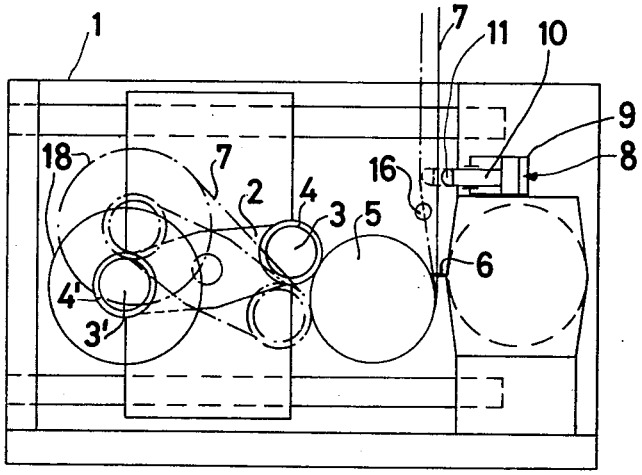
FIG. 1 is a schematic front elevational view of a winding device for the winding of threads.
Figure 2:
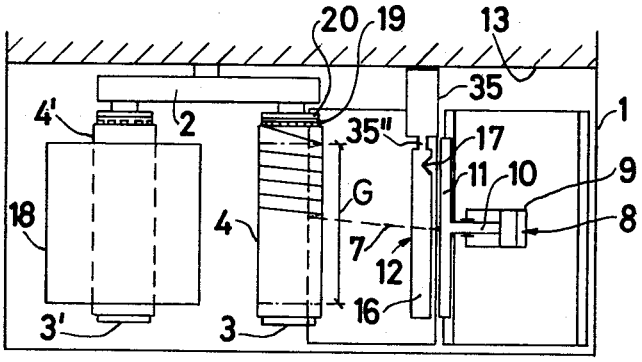
FIG. 2 is a top plan view of the winding device illustrated in FIG. 1 depicting the bobbin chuck in a position corresponding to the winding position as the same has been illustrated with full or solid lines in FIG. 1.
Figure 3:
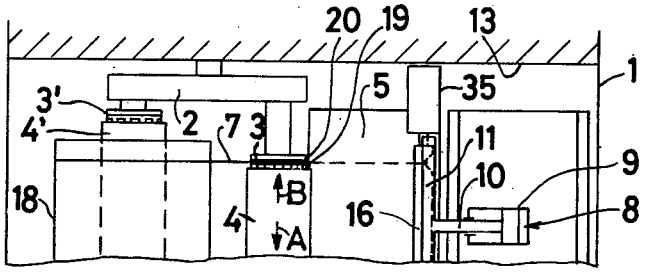
FIG. 3 is a fragmentary top plan view of the winding device depicted in FIG. 1 illustrating the bobbin chuck in its bobbin change position, i.e. immediately before transfer of the thread and as indicated with broken or dash-dotted lines in FIG. 1; plan FIG. 4 schematically illustrates in perspective view a movable thread holding device with a thread guide or thread guide member and a pivotably mounted thread guide element, and further shows in sectional view part of the bobbin chuck with a thread catching- and cutting zone and with a bobbin tube placed onto the bobbin chuck, during different steps or phases of the bobbin change operation.
Figure 6:
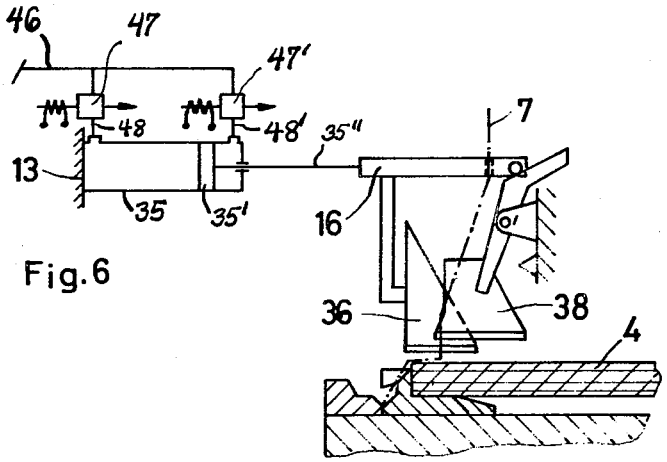
FIG. 6 illustrates on a somewhat reduced scale the thread holding device of FIG. 4 and a sectional view of the bobbin chuck with the thread catching- and cutting zone and with the bobbin tube placed on the bobbin chuck and portraying a certain phase or step of the bobbin change operation.
Figure 7:
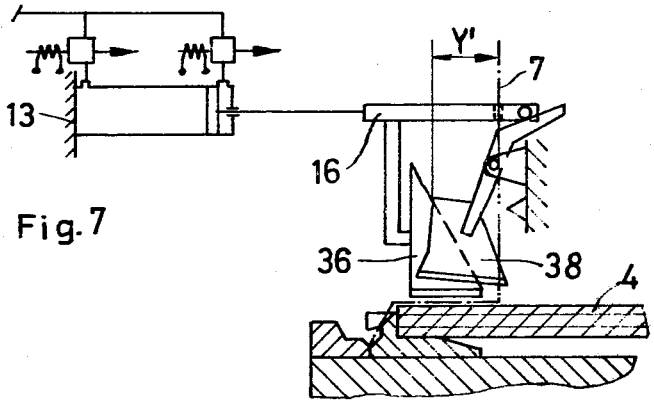
FIG. 7 is a view analogous to the illustration of FIG. 6 but portraying a further step or phase of the bobbin change operation.

Describing now the drawings, in FIGS. 1 to 3 there is shown a winding device or winder 1 for automatically changing bobbins or bobbin tubes. It is to be understood that only enough of the details of the winder 1 will be discussed hereinafter to the extent necessary for those skilled in the art to readily understand the underlying concepts of this development. The winder of the type under discussion and shown in FIGS. 1 to 3 has been disclosed in detail in the commonly assigned, copending United States application Ser. No. 447,853, filed Mar. 4, 1974, now U.S. Pat. 3,920,193, previously mentioned, and to which reference may be readily had and the disclosure of which is incorporated herein by reference.

Considering the structure of the exemplary embodiment of winding device or winder 1 for automatically changing bobbins or bobbin tubes, as the same has been depicted in FIGS. 1 to 3, it is to be understood that such embodies a rotatably supported bobbin arm 2 which can be rotated for instance in counterclockwise direction. A respective bobbin chuck 3 and 3′ is arranged at the rotatably supported bobbin arm 2, each such chuck 3 and 3′ serving to support or receive a bobbin tube 4 and 4′. A friction drive drum 5 selectively drives the bobbin chuck 3 and 3′ respectively, while a thread 7, which is traversed to- and-fro by a thread traversing device incorporating a traversing thread guide 6 or equivalent structure, is transferred onto a given one of the tubes 4 or 4′ which is in the winding position for the purpose of building-up the bobbin windings to form a bobbin package in a manner which is quite well known in this particular art.

A threading deflection device 8 is provided at the immediate or close vicinity of the thread 7 or the like at a location above the traversing thread guide 6. This thread deflecting device 8 comprises a cylinder 9 within which there is mounted for reciprocal movement a piston, which has not been particularly referenced, and which is equipped with a piston rod 10 at which there is mounted or secured a thread deflecting bar 11 or equivalent structure. At the side opposite the thread 7, as viewed from the deflecting bar 11, there is arranged a thread holding device 12. In the embodiment under discussion, this thread holding device 12 comprises a cylinder 35 (FIGS. 2 to 4 and 6 to 8) secured to a frame 13 (FIGS. 2 and 3) of the winding device or winder 1 and having a piston rod 35″ (FIGS. 2 and 4) and a rod 16 secured thereat. The piston rod 35″ which defines a drive element is operatively connected with a piston 35′ which reciprocates to-and-fro within cylinder 35. The components 35, 35′ and 35″ constitute shifting means. The rod 16 contains a thread guiding device 17 for instance in the form of a thread guide notch (shown with solid lines FIG. 2 and phantom or dash-dotted lines in FIGS. 3 and 4) at the effective zone or region G (FIG. 2) of the thread traversing arrangement. The rod 16 is movable in the direction of the arrow C (FIG. 4) which is essentially parallel to the lengthwise axis of the bobbin chuck 3 or 3′, as the case may be. As mentioned above, this portion of the apparatus construction considered above has been essentially disclosed in the aforementioned commonly assigned, copending U.S. application, Ser. No. 447,853, now U.S. Pat. No. 3,920,193.

At this point it is remarked that in the description to follow there will be considered details of the apparatus aspects of the present invention for forming reserve windings. The method of forming reserve windings with the various exemplary embodiments of the described apparatus structure of the majority of the Figures to follow constitute subject matter of our commonly assigned, copending United States application Ser. No. 616,254 filed Sept. 24, 1975, entitled "Method Of Forming Thread Reserve Windings", to which reference may be equally readily had and the disclosure of which is likewise incorporated herein by reference.

Continuing, in FIGS. 4 and 6 to 8 there is illustrated a stepwise shift of the thread. A thread guide element or member in the form of an essentially triangular thread guide plate 36 (not particularly shown in FIG. 1) is mounted through the agency of a support 37 or the like at the rod 16 between the thread guiding device or thread guide 17 and the piston rod 35″ and hence, is likewise movably arranged in the direction of the arrow C. A thread guide element in the form of a substantially trapezoidal thread guide plate 38 is connected with a lever 52 which, through the guide plate 38 is connected with a lever 52 which, through the agency of a pivot pin or shaft 54 or equivalent structure, is pivotably mounted at a frame member 53 constituting part of the winding device 1. The one free end of the lever 52 is formed as a guide or guiding edge 55 in a manner such that a guide pin 56 or equivalent structure defining a sliding point of the thread holding device 12 and which pin is mounted upon the displaceable rod 16 is guided upon the guide or guiding edge 55 during such time as the rod 16 and hence the guide pin 56 move in the direction of the arrow C. Furthermore, the guide or guiding edge 55 starting at the portion or end 55′ thereof which faces or confronts the pin 56 is arranged angled away or inclined at an angle δ (FIG. 4) with respect to the direction of movement C i.e. the lengthwise axis of the piston rod 35″. The leg of the angle δ confronting the bobbin chuck is located in the direction of movement C. The magnitude of the angle δ is dependent upon the degree or magnitude of the desired pivoting or pivotal movement in the direction S (FIG. 4) of the guide plate 38. In the starting position of the lever 52, as shown in FIG. 4, such lever rests against a stop or impact member 57 likewise provided at the frame member 53. The combination of the guide plate 38, the lever or bracket 52 and the end of the lever 52 possessing the guide edge 55 is designed in such a manner that the lever 52 in the starting position bears under the influence of its own weight against the stop or impact member 57. According to a variant embodiment the lever 52 also, for example, could be held against the stop 57 by the action of a suitable tension spring or equivalent structure (not shown) connected with the lever 52 and the frame member 53.

The thread guide plate 36 is arranged essentially parallel to the thread guide plate 38 but in comparison therewith is disposed, however, somewhat lower —as viewed from the rod 16—which elevational displacement in the showing of FIG. 9 has been indicated by the distance N. In other words, the thread guide plate 36 is arranged between the plate 38 and the traversing thread guide 6 and the bobbin tube 4 respectively. Moreover, the thread guide plate 36 and the thread guide plate 38, on the one hand, are arranged essentially parallel to the lengthwise axis of the bobbin chuck and, on the other hand, are arranged preferably at right angles or perpendicular to the course of travel of the thread 7. Additionally, the thread guide plate 36 is provided with a thread guide surface 41 (FIG. 10) and the thread guide plate 38 is provided with a thread guide notch 42 (FIG. 10).

The thread guide notch 42 is provided at the side of the thread guide plate 38 confronting the cylinder 35 and is formed by a surface 43 and a surface 44. The surface 43 forms an angle $\alpha$ with a plane E (FIG. 10) which is essentially parallel to the rod 16 and perpendicular to the thread guide plate 36 and the thread guide plate 38 respectively. This angle $\alpha$ as a rule is somewhat smaller than 90°. Angle $\alpha$ can be selected in a range of about 60°to 120°, whereas the thread guide surface 41 forms an angle $\alpha$ of about 30°with the plane E. This angle $\beta$ likewise can be chosen to be larger, i.e. up to about 60°. The thread guide surface 41 protrudes past the end edge 45 of the surface 43 in a direction towards the plane E by an amount M, as best seen by referring to FIG. 10. The notch angle $\gamma$ amounts to approximately 175°, but however, if necessary, can be reduced to 90°.

During the bobbin change operation the empty tube 4 or 4'respectively, is first brought into the position indicated in phantom or dash-dotted lines in FIG. 1 and illustrated in FIG. 3, that is to say into a position where, on the one hand, the thread 7 is still connected with the full bobbin package 18 (FIGS. 1 to 3) which is lifted-off the friction drive drum 5 but still rotates owing to the inertia of the rotating mass and, on the other hand, is already guided on a thread guiding surface 20 (FIGS. 2, 3 and 5) of the bobbin chuck 3 displaced axially in the direction of the arrow A (FIG. 3) into the position shown in FIGS. 3 and 4. The thread guiding or guide surface 20 which rotates with the bobbin chuck 3 is located adjacent a thread catching- and cutting zone 19 (FIGS. 2 and 3) which likewise rotates together with the bobbin chuck 3. This position of the thread 7 is reached in that the deflecting rod 11 (FIGS. 1 to 3) is moved into the position illustrated in phantom lines in FIG. 1, so that such thread 7, as soon as it slides into the thread guiding device 17 of the rod 16, is lifted-off the traversing thread guide 6 and is only guided by the thread guiding or guide device 17.

Now in order to shift the thread 7 from the starting position, where such thread contacts the surface 20 (FIGS. 2 and 3) to the thread catching- and cutting zone 19 and subsequently onto the tube 4, a control valve 47 which is connected with a compressed air duct or conduit 46 (FIG. 4) is actuated in such a manner that a duct or conduit 48 connecting the control valve 47 with the end of the cylinder 35 facing the frame 13 is supplied with compressed air or another suitable source of pressurized fluid medium. Furthermore, a control valve 47' connected via a duct or conduit 48' with the other end of the cylinder 35 which is located opposite the frame 13 is actuated in such a manner that the air which has been displaced by the movement of the piston 35' in the direction of the arrow C can be vented into the atmosphere or surroundings. Upon covering the distance or path X' (FIG. 4) the thread 7, on the one hand, is placed with several reserve windings W'' (FIG. 5) on the tube 4, and on the other hand, is placed in the guide notch 42 (FIGS. 4, 9 and 10). During further shifting or displacement of the rod 16 in the direction of the arrow C the thread 7, which is still guided in the thread guiding device 17, is displaced out of the guide notch 42 by the action of the guide surface 41 which of necessity also moves in the direction of the arrow C and by the movement of the guide plate 38 in the direction of the arrow S. The thread 7 is thus shifted along the surface 43 (FIG. 10) until the thread slides over the end edge or corner 45 and suddenly or in a jump-like manner covers the distance Y' owing to the guiding of the thread in the thread guiding device 17 and the thread tension, and thus forms reserve windings W corresponding to the length Y' on the bobbin tube 4 under a large helix or helical angle. The movement of the thread guide plate 38 in the direction of the arrow S is generated by the advancement of the guide pin 56 on the guide edge 55. By virtue of this movement the lever 21 is pivoted about the pivot shaft or axle 54.

Due to the movement of the thread guide plate 38 in the direction of the arrow S, in other words, with a movement substantially opposite to the direction indicated by the arrow C, there are formed reserve windings W' which cover the reserve windings W'' in the opposite winding direction. The windings W'in turn are covered by the windings W which are formed with a large helix angle in the direction of the arrow C as the thread jumps-off of the edge 45.

For returning the piston 35' the control valves 47 and 47', respectively, are reversed, i.e. the control valve 47 now flow communicates the cylinder 35 with the surrounding atmosphere, whereas the control valve 47' which is also connected with the compressed air duct or conduit 46, supplies the cylinder 14 with compressed air.

Figure 8:
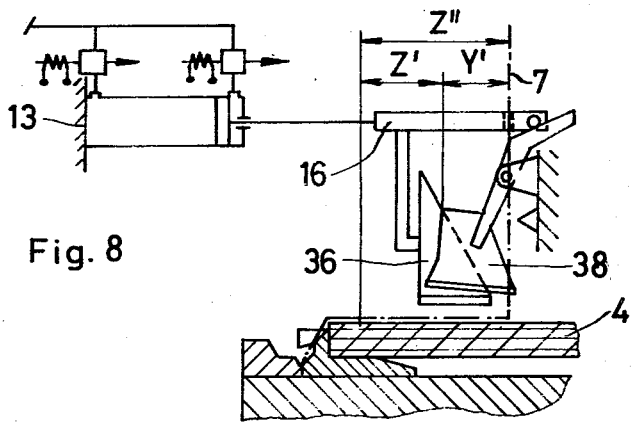
FIG. 8 is a view analogous to the showing of FIG. 6 but portraying a still further step or phase of the bobbin change operation.

If simultaneously with or after the jump-like advancement of the thread 7 from the end edge 45 the bobbin chuck 3 is moved back in the direction of the arrow B through the distance Z' (FIG. 8) into the basic or starting position shown in FIG. 2, for instance with structure as disclosed in the commonly assigned U.S. Pat. No. 3,856,222 granted Dec. 24, 1974, to Wust, then reserve windings or wraps W are formed on the bobbin tube 4 over a distance corresponding to the length Z'' (FIG. 8).

Figure 11:
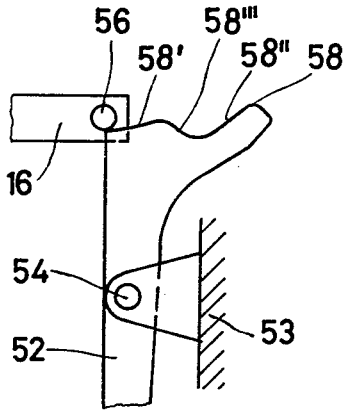
FIG. 11 schematically illustrates a variant exemplary embodiment of the pivotable thread guide element.
Figure 12:
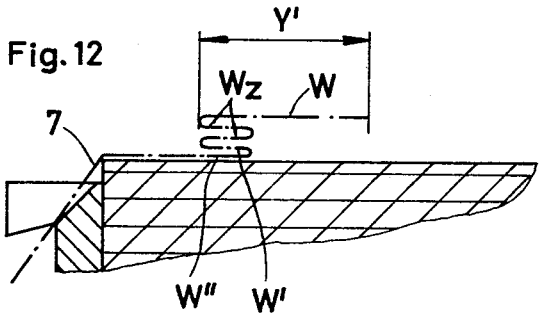
FIG. 12 is an enlarged sectional showing of the bobbin chuck with a bobbin tube and a thread reserve.

Now in the showing of FIGS. 11 and 12 there is illustrated a variant of the invention wherein a guide edge 58 is provided with two ascending portions 58' and 58'', respectively, and a descending portion 58'''. Due to the subdivision of the guide edge 58 as above described, i.e. formed of discrete portions of respective predetermined configuration e.g. undulated configuration, the thread guide plate 38 is moved twice in the direction of the arrow S while the thread slides along the surface 43, so that there are further formed additional superimposed reserve windings or wraps $W_z$ in the opposite winding direction.

Figure 13:
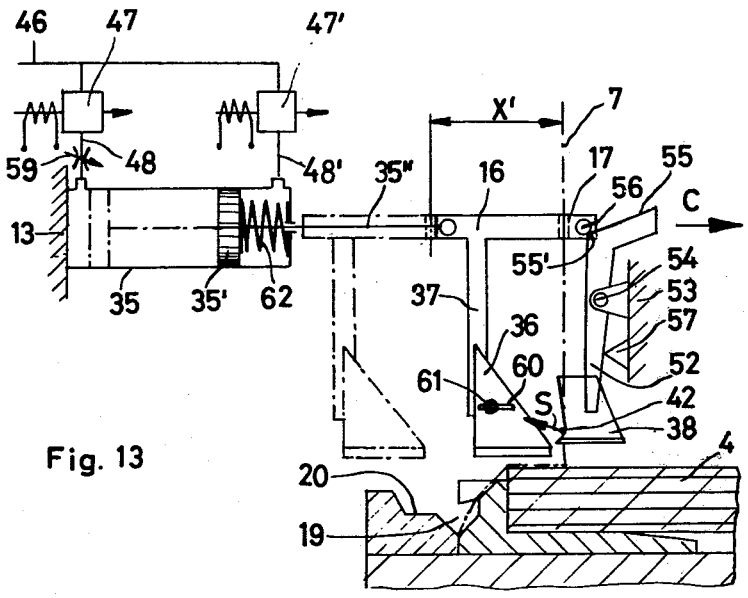
FIG. 13 illustrates a variant embodiment of the movable thread holding device according to FIGS. 4 and 6 to 8.

Now in order to be able to change in a very simple manner the length L (FIG. 5) of the windings W' as required, the thread guide plate 56 can be provided with a slotted hole 60 or equivalent structure (FIG. 13)

and fixedly held upon the support 37 by means of a screw 61 or equivalent structure guided through such slotted hole 60 or the like. In order to be able to change the position of the thread guide plate 36 relative to the support 37 it is only necessary to loosen the screw 61 and after attaining the desired position, to again tighten the same.

In order to be able to adapt or alter the number of wraps of the reserve windings W' a controllable throttle valve 59 (FIG. 13) can be mounted in the duct or conduit 48 in such a manner that the speed of the shifting movement of the piston 35'can be varied. Moreover, in order to control the shifting speed a helical spring 62 (FIG. 13) can be installed, as shown, at the end portion of the cylinder 35— as viewed in the direction of the shifting movement. By means of this spring 62 or equivalent structure the shifting speed is additionally reduced when the thread bears in the notch 42, so that as a function of the time elapsing until the thread jumps over the end edge 45 there can be deposited a corresponding number of windings or wraps.

A further advantage of the present invention, beyond the advantages already realized with the invention of the aforementioned commonly assigned, U.S. Pat. 3,920,193, resides in the fact that the reserve windings or wraps are fixed in position by being superimposed upon one another in such a manner that any loosening or unraveling of such windings is practically precluded during the doffing operation or during transport of the bobbin package or during other possibly handling of the bobbin package notwithstanding the presence of a sufficient reserve thread length contained in the windings or wraps.

While there are shown and described present preferred embodiments of the invention, it is to be distinctly understood that the invention is not limited thereto, but may be otherwise variously embodied and practiced within the scope of the following claims.

What is claimed is:

1. A winding device for automatically changing tubes for takin-up endless threads or the like, said winding device being provided with a thread traversing device for generating thread winding wraps, a thread deflecting device for lifting the thread off the thread traversing device, a thread holding device provided with a thread guiding device for guiding the thread in its lifted-off position during the change of the bobbin tube, a drive drum, and at least two bobbin chucks driven by said drive drum and alternately brought into a bobbin or tube change position respectively, each of said bobbin chucks supporting one tube, a thread catching- and cutting zone arranged adjacent to one end of the associated tube and rotating with such tube, said thread holding device being arranged such that the thread lifted off the thread traversing device is guided thereby in the immediate vicinity of the thread catching and cutting zone, shifting means for shifting the thread holding device and thereby the thread in a first thread shifting step from a position at the immediate vicinity of the thread catching- and cutting zone through such zone and onto an end portion of the tube adjacent thereto, and which shifting means in a second thread shifting step shifts the thread over a predetermined distance on such tube for creating reserve wraps, said shifting means shifting the thread at a higher shifting speed during the second step than during the first step, said shifting means comprising a substantially linearly movable drive element movable in a direction substantially parallel to the lengthwise axis of the associated bobbin chuck, said drive element being connected with the thread holding device, a first thread guide element provided with a thread guide notch for taking-up the thread after the latter has moved over a distance corresponding to the first thread shifting step, means for mounting said first thread guide element, a second thread guide element connected with the thread holding device at a location between the drive element and the thread guiding device of the thread holding device, said second thread guide element being provided with a thread guide surface arranged at an inclination with regard to the direction of movement of the thread holding device such that said thread guide surface, during such time as the thread holding device moves over a distance corresponding to the second shifting step, shifts the thread along a side surface of said thread guide notch of the first thread guide element and immediately prior to completion of the second shifting step shifts the thread over an end of such side surface, the improvement comprising:

said means for mounting the first thread guide element including means for arranging said first guide element to be movable in a direction of the thread shifting movement in a manner such that at least one additional shifting step is performed between the first and second shifting steps and which additional shifting step is directed opposite to said first and second shifting steps.

2. The winding device as defined in claim 1, further including means connected with said first thread guide element and forming a guide edge contacted by means defining a sliding point of the thread holding device, the sliding point being arranged at such a distance from the thread guiding device of the thread holding device that as the thread contacts the thread guide notch of the first thread guide element the sliding point contacts said guide edge, said sliding point while moving the guide edge sliding upon said guide edge in such a manner that the first thread guide element is shiftable in a direction opposite to the thread shifting direction.

3. The winding device as defined in claim 2, wherein the guide edge possesses discrete portions of respective predetermined configuration.

4. The winding device as defined in claim 2, wherein the means defining the sliding point comprises a pin connected with the movable drive element.

5. The winding device as defined in claim 2, wherein the direction of the guide edge, viewed in the direction of movement of the thread holding device, is inclined away from the lengthwise axis of the bobbin chuck.

6. The winding device as defined in claim 2, wherein the guide edge in order to realize said inclined direction thereof with respect to the lengthwise axis of the bobbin chuck is structured in an undulated configuration as viewed in the direction of movement of the thread holding device.

7. The winding device as defined in claim 2, wherein the first thread guide element comprises a thread guide plate, a lever, means mounting said lever for pivotal movement substantially in the direction of the thread shifting movement, said thread guide plate being connected with said lever, and wherein the thread guide plate is arranged at one end of the lever and the guide edge is arranged at the other end of the lever.

8. The winding device as defined in claim 1, including additional means for throttling the shifting speed of the thread holding device.

9. A winding device for automatically changing tubes for taking-up endless threads or the like, said winding device being provided with a thread traversing device for generating thread winding wraps, a thread deflecting device for lifting the thread off the thread traversing device, a thread holding device provided with a thread guiding device for guiding the thread in its lifted-off position during the change of the bobbin tube, a drive drum, and at least two driven bobbin chucks driven by said drive drum and alternately brought into a bobbin or tube change position respectively, each of said bobbin chucks supporting one tube, a thread catching- and cutting zone arranged adjacent to one end of the associated tube and rotating with such tube, said thread holding device being arranged such that the thread lifted off the thread traversing device is guided thereby in the immediate vicinity of the thread catching and cutting zone, shifting means for the thread holding device and thus the thread hold thereby in a first shifting step from a position at the immediate vicinity of the thread catching- and cutting zone through such zone and onto an end portion of the tube adjacent thereto, and which shifting means in a second step shifts the thread over a predetermined distance on such tube for creating reserve wraps, said shifting means shifting the thread at a higher shifting speed during the second step than during the first step, the improvement comprising:

said shifting means including a thread guide element, means for mounting said thread guide element for movement in a direction substantially opposite to the direction of the thread shifting movement in a manner such that at least one additional shifting step can be performed between the first and second shifting steps, said additional shifting step being directed opposite to said first and second shifting steps.

* * * * *